United States Patent [19]

Rossato

[11] Patent Number: 4,828,222

[45] Date of Patent: May 9, 1989

[54] MOTOR VEHICLE LIFT

[76] Inventor: Eride Rossato, Via Mazzini, 7
30035-Ballo'di Mirano, Italy

[21] Appl. No.: 130,872

[22] PCT Filed: Apr. 3, 1987

[86] PCT No.: PCT/EP87/00182

§ 371 Date: Dec. 2, 1987

§ 102(e) Date: Dec. 2, 1987

[87] PCT Pub. No.: WO87/06219

PCT Pub. Date: Oct. 22, 1987

[51] Int. Cl.[4] ..... E02C 3/00

[52] U.S. Cl. ..... 254/88; 254/90; 254/124

[58] Field of Search ..... 254/88, 90–91, 254/122, 124, 8 R, 8 C, 9 N, 9 C; 187/8.47, 8.71, 18, 10

[56] References Cited

U.S. PATENT DOCUMENTS 2,530,137 11/1950 Wallace .
3,117,765 1/1964 Chiuzzi .
4,447,042 5/1984 Masui .

FOREIGN PATENT DOCUMENTS 546682 4/1956 Belgium .
2245613 9/1972 Fed. Rep. of Germany .
3529069 3/1986 Fed. Rep. of Germany .
1111799 3/1956 France .
1169210 12/1958 France .
1219477 5/1960 France .
1281705 2/1962 France .
1240101 7/1971 United Kingdom .

*Primary Examiner*—Robert C. Watson
*Attorney, Agent, or Firm*—Hoffman, Wasson, Fallow & Gitler

[57] ABSTRACT

A motor vehicle lift comprising in combination:

a pair of base longitudinal members (1) for its support on and/or securing to the floor, a pair of first uprights (2) hinged lowerly to said longitudinal members (1), a pair of second uprights (4) hinged lowerly to said longitudinal members (1) and upperly to said first uprights (2) at an intermediate point thereof, a pair of vehicle lifting runways (6) hinged to the upper end of said first uprights (2) and formed in several separate parts which are kept substantially aligned when the lift is lowered, a pair of actuators (17) acting so to vary the reciprocal contained angle of said pairs of first uprights (2) and second uprights (4), for raising the lift, and a pair of members (15,15') interposed between said first uprights (2) and the portion (8) of runways (6) hinged to said first uprights (2) to check their reciprocal contained angle during the raising of the lift, the hinging between a pair of said uprights (2,4) and said longitudinal members (1) being of such a type as to enable the lower end of said pair to slide along said longitudinal members.

15 Claims, 3 Drawing Sheets

MOTOR VEHICLE LIFT

BACKGROUND OF THE INVENTION

This invention relates to a motor vehicle lift.

Motor vehicle lifts are known. They are constructed in the most various forms and sized according to their application and operator requirements, with obviously different performance and costs.

A known vehicle lifting device is the so-called "two column lift". It comprises a pair of vertical columns provided with a base for fixing to the floor and/or with members for connecting them together, and a pair of horizontal raisable arms. The two columns are generally positioned at a distance apart which exceed the maximum width of the vehicles to be lifted, and have their arms hinged to pivots parallel to the column axis. Rubber pads or other conventional members are provided at the opposite end of each arm to lift the vehicle to the required height as a result of the simultaneous raising of the two pairs of arms.

This type of vehicle lifting device is widely used, particularly in vehicle repair shops, as it combines substantially low cost with good operating reliability and the facility for lifting the vehicle to a height which enables the mechanic to work under it.

However, it also has serious limitations, and in particular:

large overall size, in that the two columns, their bases and the relative connections form a fixed installation which when not being used hinders proper vehicle handling within the workshop, whereas during periods of use it hinders the action of the mechanic, who for example can have difficulty in opening the door of the lifted vehicle, the need for laborious installation in that the columns have to be fixed securely to the floor by fixing members expressly provided for this purpose, considerable fatigue in carrying out the operations required for lifting the vehicle. In this respect, in order to be usable with vehicles of widely different widths the two columns must be sufficiently spaced apart to allow the widest vehicle to pass, whereas the arms must be of sufficient length to reach the narrowest vehicles. This large arm length means that when they are to be positioned under the body of a wide vehicle, it is very often necessary to carry out this operation in two stages by inserting one arm at a time and moving the vehicle along the ground forwards or backwards before inserting the second arm, to prevent it being hindered by the wheels.

So-called "parallelogram" lifts are also known, comprising a pair of longitudinal members resting on the ground, a pair of horizontal runways which can be raised relative to the longitudinal members to lift the vehicle disposed on them, and a number of pairs of arms or uprights hinged in the form of a parallelogram to the runways and longitudinal members, and operated by generally hydraulic systems to cause the runways to rise. This known type of lift is widely used, essentially because of its simplicity of installation, its strength and its reliability of operation. However it has limitations substantially in terms of its bulk and its difficulty of operation under certain conditions of use.

The bulk drawback also applies to its most favorable conditions, in that when the runways are raised, the longitudinal members, the uprights and the inevitable running boards or ramps for driving the vehicle onto the runways not only require a certain space, but represent and obstruction for the mechanics who have to work under the lifted vehicle.

Moreover, when the lift is raised, the fact that the vehicle rests on the runways by means of its wheels makes it impossible to do any work which requires the wheels to freely rotate or to be removed. For these reasons, it has previously been proposed to provide the runways with supplementary running boards which allow further lifting of the vehicle above the runways when the lift has already lifted the vehicle above the floor, but on the one hand this inevitably complicates the lift construction, and on the other hand it has not completely solved the problem in that the runways can obstruct access to the lower part of the vehicle in the region of the wheels.

SUMMARY OF THE INVENTION

According to the present invention, all these drawbacks jointly and separately encountered in the prior art, are obviated by a motor vehicle lift characterised by comprising in combination:

- a pair of base longitudinal members for its support on and/or securing to the floor,
- a pair of first uprights hinged lowerly to said longitudinal members,
- a pair of second uprights hinged lowerly to said longitudinal members and upperly to said first uprights at an intermediate point thereof,
- a pair of vehicle lifting runways hinged to the upper end of said first uprights and formed in several separate parts which are kept substantially aligned when the lift is lowered,
- a pair of actuators acting so to vary the reciprocal contained angle of said pairs of first uprights and second uprights, for raising the lift, and
- a pair of members interposed between said first uprights and the parts of runways hinged to said first uprights to check their reciprocal contained angle during the raising of the lift, the hinging between a pair of said uprights and said longitudinal members being of such a type as to enable the lower end of said pair to slide along said longitudinal members.

BRIEF DESCRIPTION OF THE DRAWINGS

Four preferred embodiments of the present invention are described in detail hereinafter with reference to the accompanying drawings, in which.

DESCRIPTION OF THE PREFERRED EMBODIMENT

Figure 1:
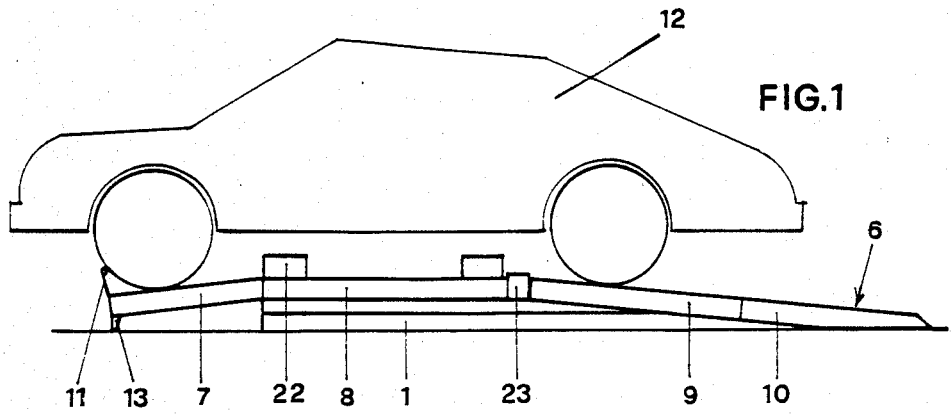
FIG. 1 is a side view of a first embodiment of a lift according to the invention supported on the floor and shown in its lowered state.

As can be seen from the figures, the lift according to the invention comprises a pair of longitudinal members 1 essentially of C shape with their opening facing upwards.

These longitudinal members are rested on or bolted to the floor or, in the embodiments shown in FIGS. 6 to 9, to the base of suitable seats provided therein.

A pair of first uprights 2 are associated with the two longitudinal members 1, and are provided at their lower end with rollers 3 slidable longitudinally within the relative longitudinal member.

To the two longitudinal members 1 there is also hinged the lower end of a pair of second uprights 4, having a length substantially equal to one half the length of the first uprights 2. The two hinge pins between the longitudinal members 1 and uprights 4 are rigidly connected together by a single torsion bar 5.

The upper end of each upright 4 is hinged to the corresponding uprights 2 on a horizontal axis situated approximately in a central position.

The lift according to the invention also comprises a pair of runways indicated overall by 6 and formed from a substantially C-shaped section having a width slightly greater than the width of the longitudinal members 1 and their opening facing downwards.

Figure 2:
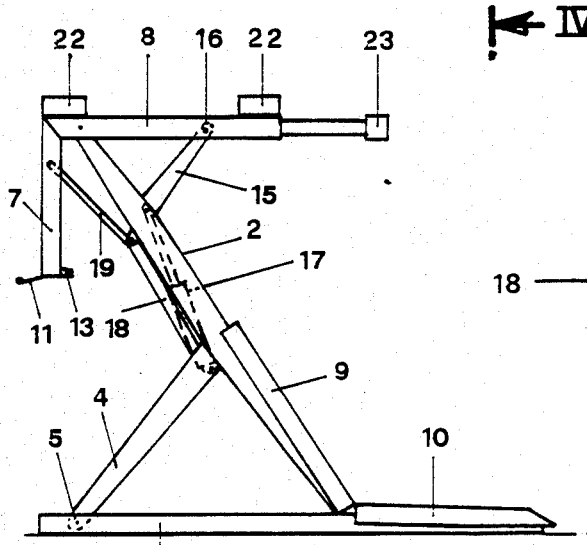
FIG. 2 shows the lift in its raised state.
Figure 4:
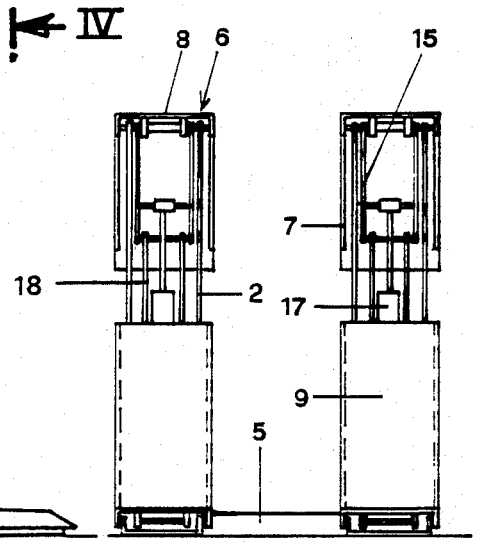
FIG. 4 is a front view thereof on the line IV—IV of FIG. 2.
Figure 5:
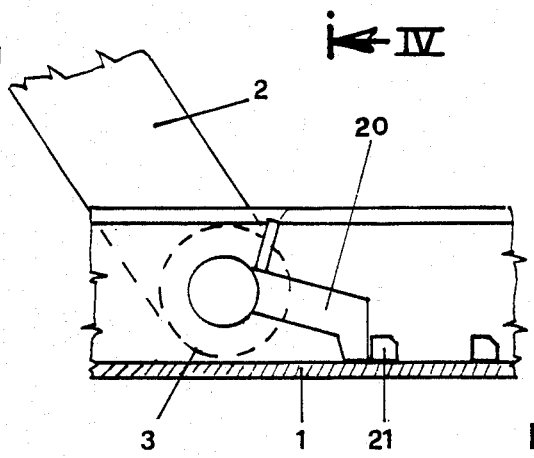
FIG. 5 is a longitudinal section view of the enlarged detail of the bond between the lower end of the first uprights and the longitudinal.
Figure 3:
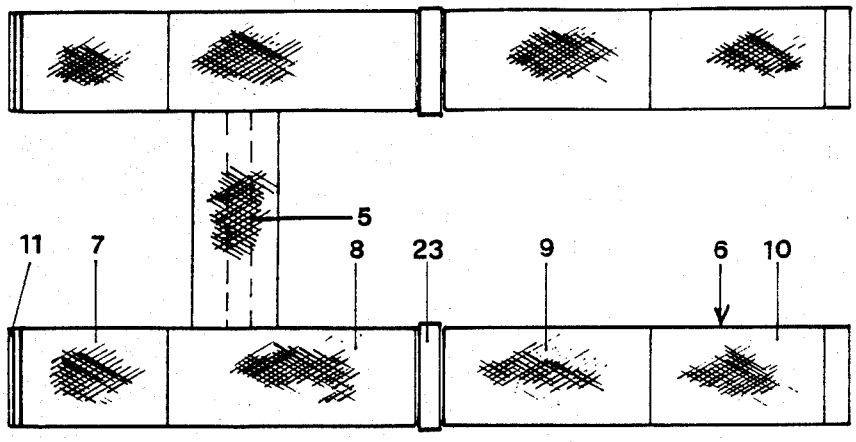
FIG. 3 is a top view thereof.

In the embodiment shown each runways 5 is in reality divided into four portions 7,8,9 and 10. With reference to FIGS. 1 to 3, the left hand end portion 7 has a skirt 11 welded to its outer end and extending vertically downwards beyond the vertical limits of the runway to act as a stop for the vehicle 12 and as a leg for its resting on the floor. For this latter purpose the skirt 11 is provided at its lower end with a roller 13.

The portion 8, to one end of which the portion 7 is hinged, represents the portion which is to support the vehicle 12 to be lifted. In proximity to that end joined to the portion 7, it is hinged to the upper end of the corresponding upright 2.

The third portion of the runway 9 is in fact not raised by the corresponding base longitudinal member 1. It embraces and is fixed to the lower portion of the corresponding upright 2 and has the fourth terminal portion 10 of the runway 1 hinged to its end close to the longitudinal member 1.

The height of this terminal portion 10 gradually falls to zero in passing from the end connected to the portion 9 to its opposite end, and also forms the drive ramp for the vehicle 12.

The lift according to the invention also comprises a pair of arms 15 which in proximity to one end are hinged to the uprights 2 and at their other end are provided with a roller 16 slidable on the lower surface of the horizontal web of the runway portion 8.

Between each upright 4 and the corresponding upright 2 there is disposed an actuator 17, which in this embodiment is a hydraulic cylinder-piston unit. More precisely the cylinder of the cylinder-piston unit 17 is hinged to the upright 4 about an axis different from the axis on which said upright 4 is hinged to the upright 2, whereas the rod of the cylinder-piston unit 17 is hinged to the same pin by which the arm 15 is hinged to the upright 2. There is alos provided a hinged connection between the arm 15 and the relative upright 4, this connection consisting of a rigid rod 18 hinged at one end to the arm 15 on an axis different from the axis on which it is hinged to the upright 2 and situated at the opposite end to the roller 16, and is hinged at its upper end on the same axis as that on which the cylinder-piston unit 17 is hinged to the upright 4.

A further rod 19 is hinged on the same axis as that on which each rod 18 is hinged to the corresponding arm 15 and connects said arm to the end portion 7 of each runway on a hinging axis different from that on which said portion 7 is connected to the portion 8.

A conventional saftey system consisting os a pawl 20 provided at the lower end of each upright 2 and a plurality of teeth 21 provided on the base of the longitudinal member 1 prevent, by conventional means, the accidental lowering of the lift should a fault develop in the hydraulic lifting plant.

The lift according to the invention also comprises a central control unit and a plurality of monitoring and control members which are of known type, and therefore do not form a subject matter of the present invention. They are therefore not shown on the drawings for reasons of clarity.

The operation of the lift according to the invention is as follows:

when in its lowered state (see FIG. 1), the two actuators 17 are in their condition of minimum extension. The portion 7 of each runway rests with the end skirt 11 on the floor, and has its other end at a slightly higher level.

The other three portions 8,9 and 10 of each runway are substantially aligned to form the prolongation of the runway; the portion 8 is substantially horizontal whereas the portions 9 and 10 are inclined with a slope opposite that of the portion 7. In particular, the end edge of each portion 10 rests on the floor to form the drive-on ramp for the vehicle 12.

Under these conditions, a vehicle 12 driven onto the runways 6 via the portions 10 can be positioned with its front wheels against the skirts 11. Because the slope of the portion 7 opposes that of the aligned portions 9 and 10, and by virtue of suitable dimensioning of the various parts and the slopes assigned to them, a vehicle of average size resting with its front wheels against the skirts 11 and with its rear wheels beyond the portions 8 of the runways 6 and substantially at the same level, lies substantially horizontal so that the wheels need not be braked.

Before raising the lift, two conventional hard rubber pads 22 are placed at the two ends of each portion 8 of the runways 6 in correspondence with the scheduled points of the vehicle body by which the vehicle 12 is to rest; operating fluid is then fed into the actuators 17. As these actuators extend, the particular choice of the various hinge points means that the following effects are obtained:

the uprights 4 and 2, which are disposed almost coplanar when the lift is lowered, rotate relative to each other so as to reduce their contained angle. Whereas the uprights 4 are hinged to the longitudinal member 1 and can only rotate about them, the upright 2 can also slide along said longitudinal members so that the pawls 20 jump over the teeth 21 one at a time, to thus attain the various safety position;

the arms 15, which when the lift is in its lowered configuration are practically coplanar with the uprights 2, rotate about these latter, while tending to preserve a condition of substantial parallelism to the uprights 4;

the runway portions 8 rise both because they are hinged to the upper end of the uprights 2 and because they rest on the upper end of the arms 15, which slides below the relative portion 8;

the runway portions 7 connected to the lower end of the arms 15 by the rigid rods 19 incline downwards;

the portions 9 follow the upright 2 and cause the portions 10 to slide axially on the longitudinal members 1;

as the movement of the portions 7 and 9 on which the wheels rest relative to the portions 8 on which the pads 21 are provided, the vehicle 12 rests with its body on said pads, to leave the wheels free to rotate.

In the final raised lift configuration (see FIG. 2):

the runway portions 7 are completely folded down and in no way hinder access from underneath to the front wheels or to the engine compartment of the vehicle 12;

the runway portions 8 lie perfectly horizontal and the vehicle remains resting on them by way of the pads 22;

the runway portions 10 are almost completely superposed on the corresponding portions of the longitudinal members 1, so reducing the space taken up by the lift at floor level to merely the length of the longitudinal members 1 and thus facilitating the movements of the operator below the lift and his access to the entire lower part of the vehicle 12.

On termination of the work, in order to relower the lift it is necessary only to discharge the operatiang fluid from the actuators 17, the lift then reassuming its lowered configuraton shown in FIG. 1, to allow the vehicle to descend from the runways 6.

To make it possible for the lift to be also used for a vehicle of length exceeding the maximum length acceptable by virtue of the lift dimensions, extensions 23 are applied to the end of the runway portions 8, and which when not in use remain totally housed in corresponding tubular guides in the portions 8, but can be extracted outwards when required, in order to support pads 22 at a greater distance from those provided at the opposite end of the portions 8.

Finally in order to retard the rising of the portion 7 while the lift is being lowered (or to anticipate the folding of the portions 7 during the raising of the lift, this amounting to the same thing) the rods 18 instead of being rigid can be of telescopic type, with the facility for undergoing a short idle stroke before offering a rigid reaction to a concentrated load.

Figure 6:
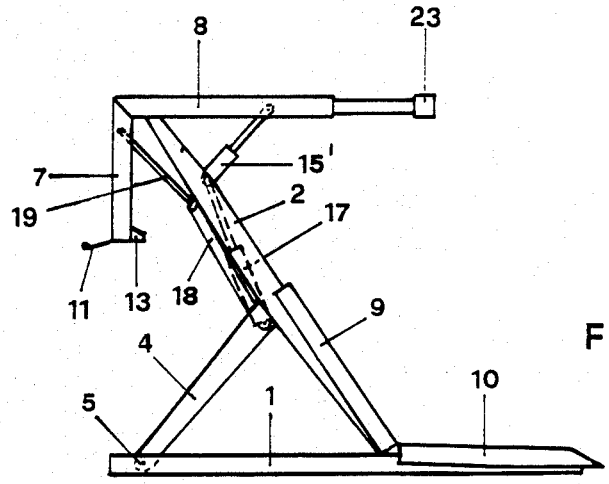
FIG. 6 shows a second embodiment of a lift in the same view as FIG. 2.
Figure 8:
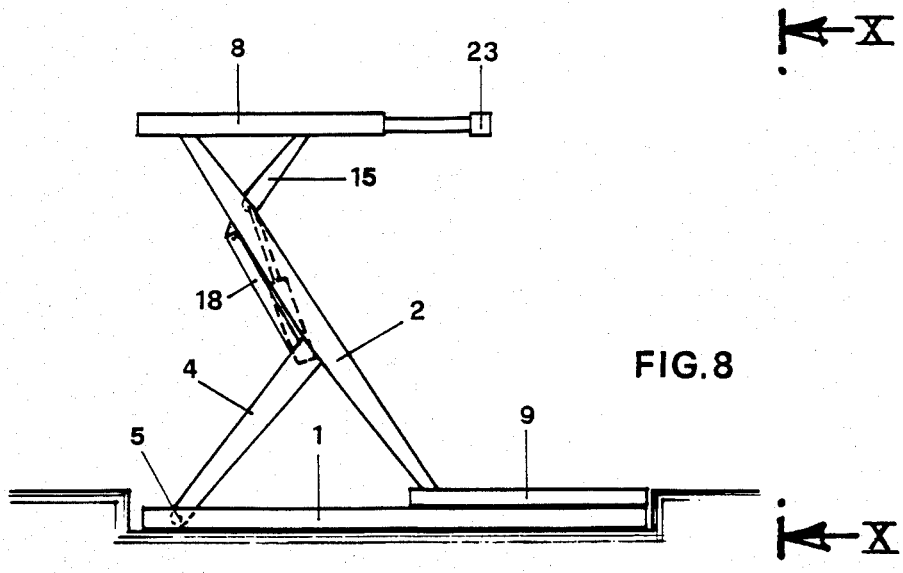
FIG. 8 shows the lift of FIG. 7 in the same view as FIG. 2.

In the embodiment shown in figure 6 rather than using a rigid connection between the first uprights 2 and the portions 8 of the runways 6, a variable length connection is used, and in particular a pair of cylinder-piston units 15' which have the function of enabling the inclination of the portions 8 with respect to the floor.

This is very advantageous for the body shops where particular works (for example the applying of the antinoise paint to the vehicles underside) result more comfortable if it is possible to work with the vehicle inclined.

In the embodiment shown in the FIGS. 7 to 10 the lift is in the "embedded" version in the floor. This is of more simple construction as it does not require the presence of ramps for the vehicle to drive onto the runways. In this case, the runways 6 comprise only the portions 8,9 which are perfectly horizontal and coplanar with the floor when the lift is lowered.

Figure 7:
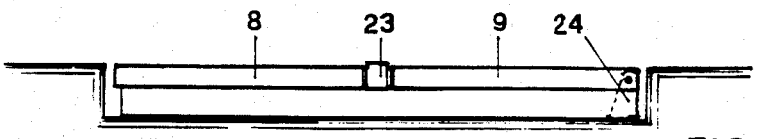
FIG. 7 shows a third embodiment of a lift in the same view as FIG. 1.
Figure 9:
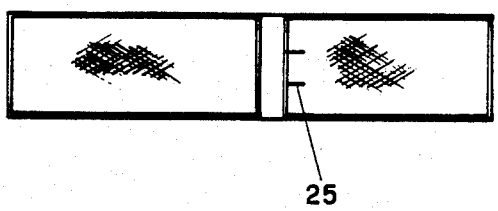
FIG. 9 shows the lift of FIG. 7 in top view.
Figure 10:
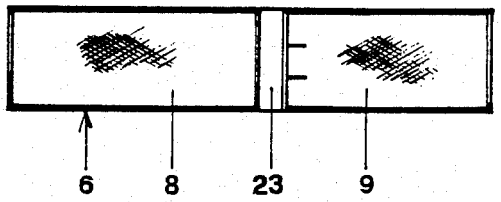
FIG. 10 shows the lift of FIG. 7 in front view on the line X—X of FIG. 8.
Figure 10:
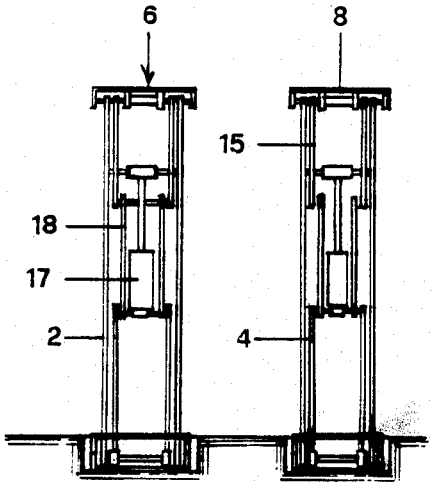

More precisely the portions 8 are bound to the first uprights 2 and to the member 15 or 15' as shown previously, whereas the portions 9 are hinged, in correspondance of the side end, to appendices 24 soldered to the end of the longitudinal members 1 and are freely raisable for a length necessary to enable the movement of the uprights. A pair of longitudinal engravings provided in the inner end of each portin 9 enables the partial penetration of the uprights 2 in the portions 9 and therefore ensures the horizontality of said portions 9 when the lift is completely raised (FIG. 7).

Figure 11:
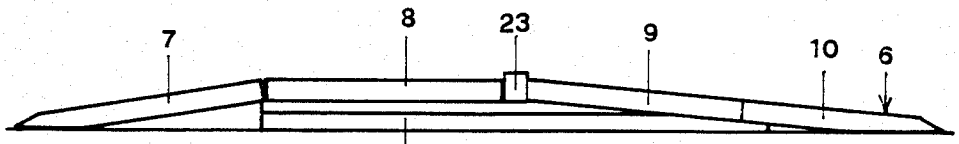
FIG. 11 shows a fourth embodiment of a lift in the same view as FIG. 1.
Figure 12:
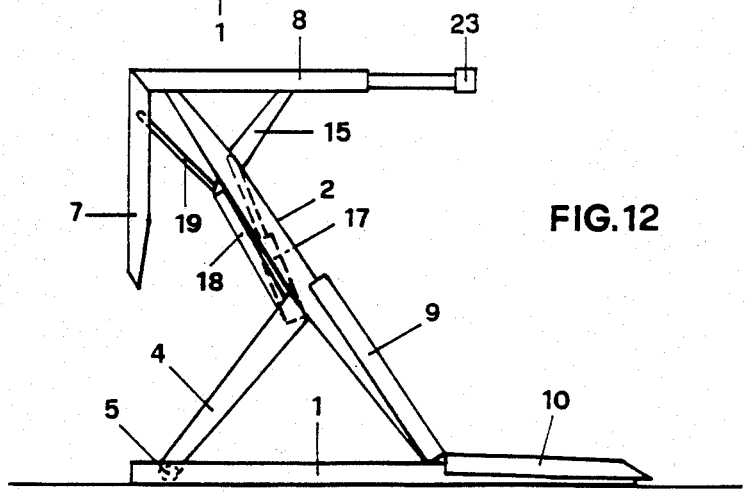
FIG. 12 shows the lift of FIG. 7 in the same view as FIG. 2.

The embodiment shown in FIGS. 11 and 12 differs from the embodiments shown in FIGS. 1 to 4 as it is of two-faced type in order to enable the vehicle to raise from both the ends of the runways 6.

From the aforegoing, it is apparent that the lift according to the invention, independently from the used embodiment, is considerably more advantageous than conventional lifts, in that:

it is of very simple formation, requiring the longitudinal members 1 to be merely rested on or fixed to the floor or to be positioned in suitable seats arranged therein, its "above floor" version occupies a very small space when in its lowered state, whereas its "embedded" version occupies practically no space at all, there is practically no limitation on its extent of lifting, and it can therefore be used not only in tire service stations where only a limited extent of vehicle but also in body shops where the vehicle needs to reach a greater height, and in repair shops in which the operator must be able to work standing up below the lifted vehicle, it creates no obstacle to the operator working below the lifted vehicle, because of the total absence of impediments on the runways 6, and also because of the reduction in the space taken up in the above-floor version in passing from the lowered configuration to the raised configuration.

it enables, besides the raising of the vehicles, also its inclination in the case in which the connection between the portions 8 of the runways 6 and the first uprights 2 is obtained through the cylinder-piston units 15'.

I claim:

1. A motor vehicle lift comprising in combination a pair of longitudinal base members adapted to engage a shop floor, a pair of first uprights each pivotally supported at its lower end on a respective one of said base members, a pair of second uprights each hinged at its lower end to a respective one of said base members, and at its upper end to a respective one of said first uprights at an intermediate point thereof, a pair of vehicle lifting runways each including a segment hinged to the upper end of a respective one of said first uprights, each of said runways comprising plural segments which are substantially contiguous when the lift is lowered, actuator means for varying the angular relationship between said pair of said first uprights and said pair of second uprights, so as to raise said runways, and a pair of control members each interposed between a respective one of said first uprights and a first segment of a respective runway to which said first upright is connected, to control the angularity of the first segment as the lift is raised, one of said pairs of uprights being connected to said base members in such a way as to permit the lower end of said each of said uprights to slide along said base members.

2. The lift of claim 1, wherein each runway comprises a second segment hinged to said first segment, and further comprising means for causing said second segment to fold downwards during the raising of the lift.

3. The lift of claim 2, wherein said second segment is provided at its free end with a skirt for halting a wheel of a vehicle and for resting on the floor when the lift is lowered.

4. The lift of claim 3, further comprising a rod hinged at one end to said second segment and at a second end to a respective control member, thereby causing said second segment to fold downward as the lift is raised.

5. The lift of claim 2, wherein each runway further comprises a third segment fixed to the lower part of the respective first upright, and a fourth segment hinged to said third segment and adapted to slide on the respective base member when the lift is raised.

6. The lift of claim 5, wherein, when the lift is lowered, the second segment is slightly inclined, with its free end lower than its hinged end, and wherein the third and fourth segments are inclined downward in the opposite direction, thereby enabling a vehicle to drive onto the ramp.

7. The lift of claim 1, wherein at least one of said pairs of uprights are interconnected at their lower ends by a torsion bar.

8. The lift of claim 1, wherein the actuators are disposed between said first and second uprights.

9. The lift of claim 1, wherein each control member is a rigid arm pivotally connected near one of its ends to once of said uprights.

10. The lift of claim 1, wherein said second uprights are substantially half as long as said first uprights, and are hinged to the midpoint of the latter.

11. The lift of claim 1, further comprising means for preventing descent of said runways in the event of failure of said actuators.

12. The lift of claim 11, wherein said preventing means are contained within said actuators.

13. The lift of claim 11, wherein said preventing means comprise teeth attached to the base members, and cooperating pawls connected to the lower of end that pair of uprights that is slidable along the base members.

14. The lift of claim 1, further comprising extensions normally housed within said first segments, said extensions being extendable from said first segments to support long vehicles.

15. The lift of claim 1, wherein the base members are recessed into the floor, and wherein each runway comprises a first segment hinged to a respective one of said first uprights, and another segment hinged to a respective longitudinal member, said segments being coplanar when the lift is in its lowered position.

* * * * *